US005741164A

United States Patent [19]

Yasuno et al.

[11] Patent Number: 5,741,164

[45] Date of Patent: Apr. 21, 1998

[54] TERMINAL DEVICE OF COIL

[75] Inventors: Kazushi Yasuno; Tsutomu Hasegawa, both of Saitama, Japan

[73] Assignee: Toyodenso Kabushiki Kaisha, Tokyo, Japan

[21] Appl. No.: 662,522

[22] Filed: Jun. 13, 1996

[30] Foreign Application Priority Data

Jun. 13, 1995 [JP] Japan ..... 7-145960

[51] Int. Cl.[6] ..... H01R 13/02

[52] U.S. Cl. ..... 439/889; 439/890; 336/192

[58] Field of Search ..... 439/889, 890, 439/874; 336/192; 228/135, 136

[56] References Cited

U.S. PATENT DOCUMENTS 3,566,465 3/1971 Weiner ..... 336/192

4,736,508 4/1988 Poli et al. ..... 228/136

*Primary Examiner*—Gary F. Paumen

*Assistant Examiner*—T. C. Patel

*Attorney, Agent, or Firm*—Birch, Stewart, Kolasch & Birch, LLP

[57] ABSTRACT

A first terminal and a second terminal are provided, in which a winding terminal of a coil is connected to the first terminal and one end of the second terminal is positioned to overlap one end of the first terminal. One end of each terminal is connected by a soldered portion 12. One end of the first terminal is designed to serve as an engaging projection which is bent at a generally right angle to the longitudinal direction thereof. The engaging projection engages an engaging opening formed on one end of the second terminal. A constricted part is formed near the engaging opening to reduce heat escape. Because the first terminal and the second terminal are firmly secured to each other, a soldered portion is not affected by stress resulting from differences in the coefficients of thermal expansion of the terminals, the solder and the resin due to a change in application temperature and therefore, the reliability of the soldered connection is improved.

11 Claims, 5 Drawing Sheets

TERMINAL DEVICE OF COIL

BACKGROUND OF THE INVENTION

1. Field of the Invention

This invention relates to a terminal device suitable for use in a pickup coil or the like of an electric device for vehicles.

2. Description of Background Art

A terminal device is generally known which comprises a first terminal connected to a winding terminal of a coil, and a second terminal. One end of each of the first terminal and the second terminal is positioned to overlap the other and is soldered to connect the two terminals. Fluid resin is then injected to form a mold.

In the foregoing structure, because there is a difference in the coefficients of thermal expansion of the terminals, the solder, and the resin due to a change in application temperature, stress is applied to the soldered connection. Reliability of the soldered connection may therefore be compromised.

Further, a phenomenon whereby the heat from the soldering iron escapes along the first and second terminals so as to lower the temperature of the soldering iron often affects the efficiency of the soldering.

It is therefore an object of the present invention to solve the problems of the above described prior art device.

SUMMARY OF THE INVENTION

According to the present invention, a terminal device of a coil is provided which comprises a first terminal to one end of which a winding terminal of the coil is connected, a second terminal disposed in the same longitudinal direction as the first terminal with its top end positioned to overlap the other end of the first terminal, thereby connecting the top end of the second terminal to the other end of the first terminal by soldering, and means provided on one of the first terminal or the second terminal for limiting the displacement in the longitudinal direction of the first terminal and the second terminal and preventing stress from being applied to the soldered portion.

The means, for example, may be realized by forming an engaging projection on one of the first terminal or the second terminal and by forming an engaging opening on the other of the first terminal or the second terminal for engaging the engaging projection.

With the construction described above, when the engaging projection formed on one of the first terminal or the second terminal engages the engaging opening formed on the other of the first terminal or the second terminal, because the connecting portion of the first terminal is firmly secured to the second terminal, the soldered connection is not affected by stress resulting from differences in the coefficients of thermal expansion of the terminals, the solder, and the resin due to a change in application temperature and it is possible to improve the reliability of the soldered connection.

Further, if a constricted area is formed near the engaging opening, the heat escape is reduced by the constricted part so that it is possible to keep the soldering iron from being cooled and to improve the soldering efficiency.

On the other hand, if the engaging projection is formed by bending a portion of one of the first terminal or the second terminal, formation of the engaging projection is simplified and the production costs can be reduced.

The above and other objects, features and advantages of the present invention will become more apparent from the following description and the appended claims, taken in conjunction with the accompanying drawings.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENT

One embodiment applied to a pickup coil forming an electric device for vehicles will be described with reference to FIGS. 1 through 7.

Figure 2:
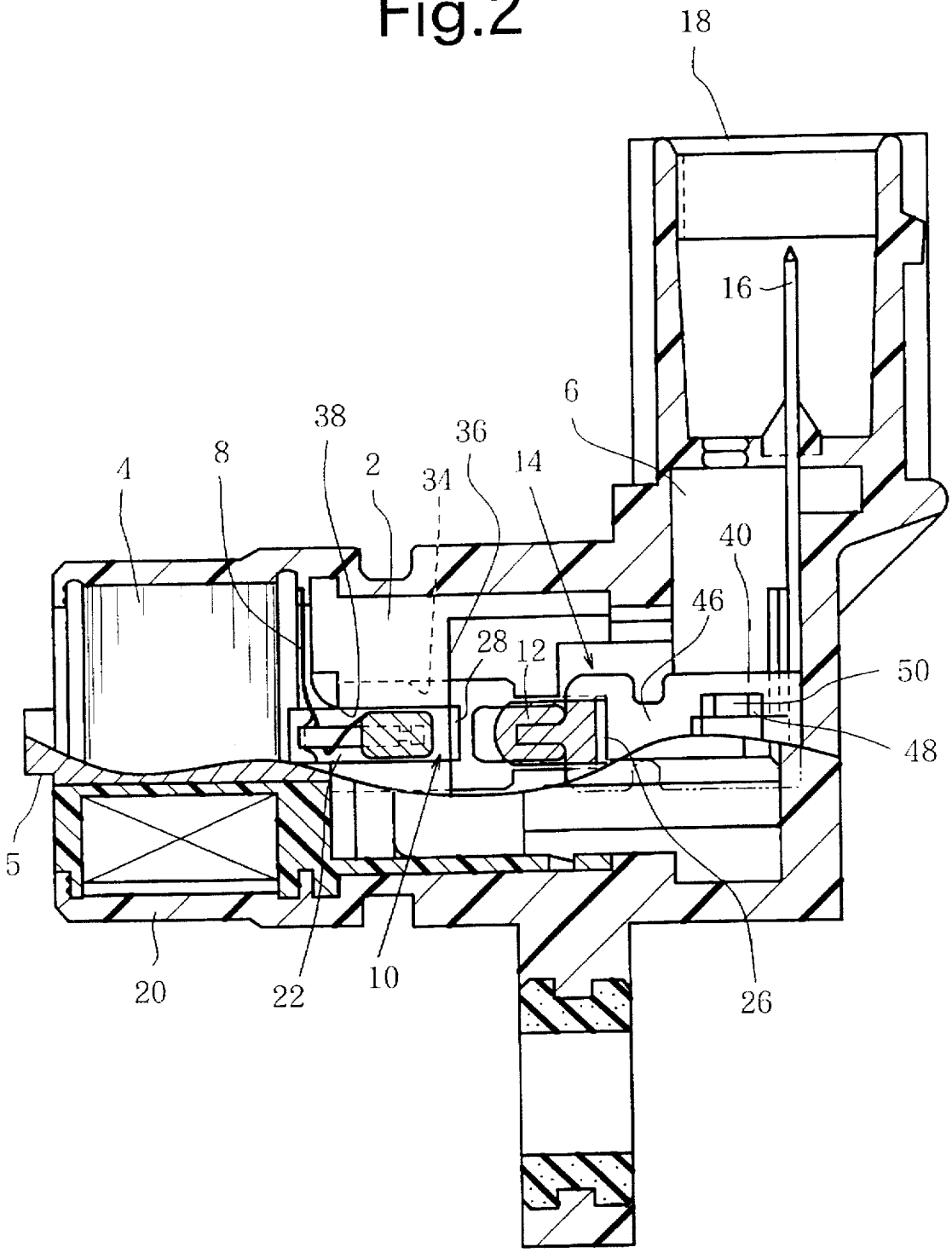
FIG. 2 is a full cross-sectional view of a pickup coil according to the embodiment.

FIG. 2 is a full cross-sectional view of this pickup coil which includes a coil 4 wound around one end of a bobbin 2. A terminal base 6 is connected to the other end of the bobbin 2 and extends in a direction perpendicular to the axis of an iron core 5 inserted in the center of the coil 4. A first terminal 10 is secured on a side of the bobbin 2 in the axial, longitudinal direction of the coil 4. A winding terminal 8 is connected to one end of the first terminal 10, a second terminal 14 is connected at one end thereof to the other end of the first terminal 10 by a soldered portion 12. A coupler terminal 16 is formed on the other end of the second terminal 14 by bending the other end of the second terminal 14 in a general L-shape. A coupler portion 18 enclose the coupler terminal 16. A mold portion 20 is integrally formed with the coupler portion 18 to form an outer configuration of the entire pickup coil device.

Figure 4:
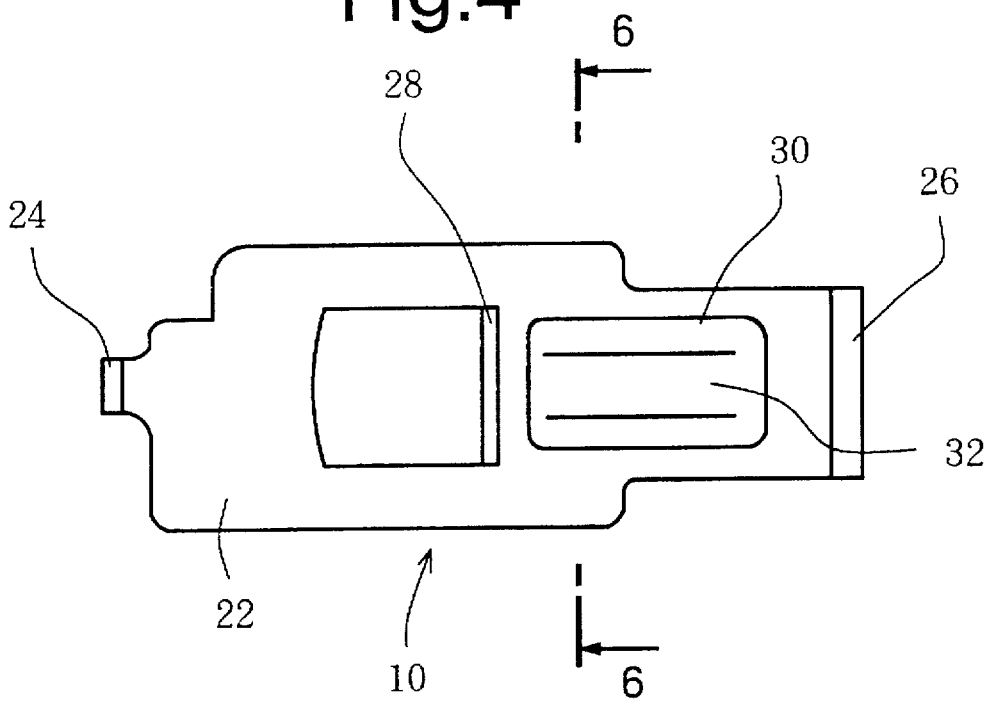
FIG. 4 is a front view of the first terminal.
Figure 5:
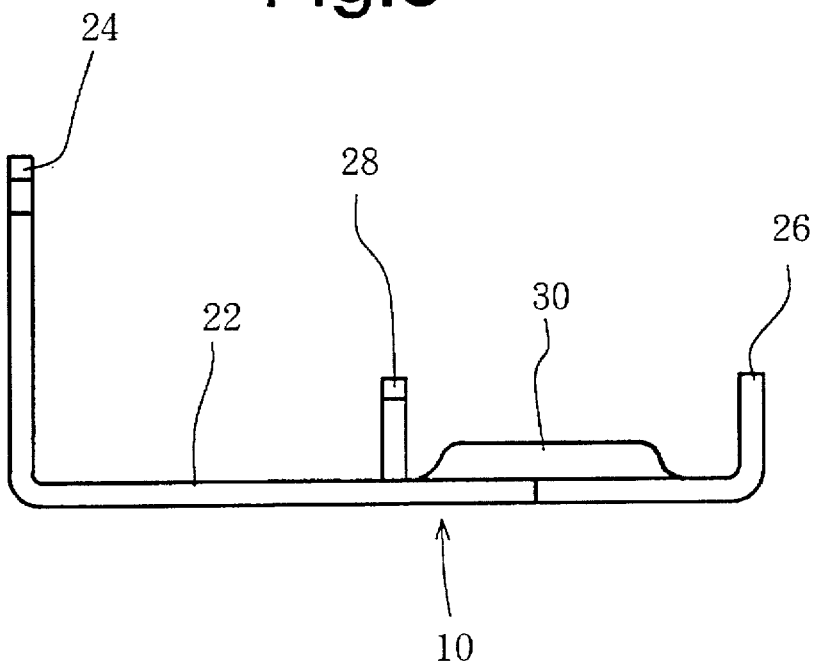
FIG. 5 is a side view of the first terminal.
Figure 6:
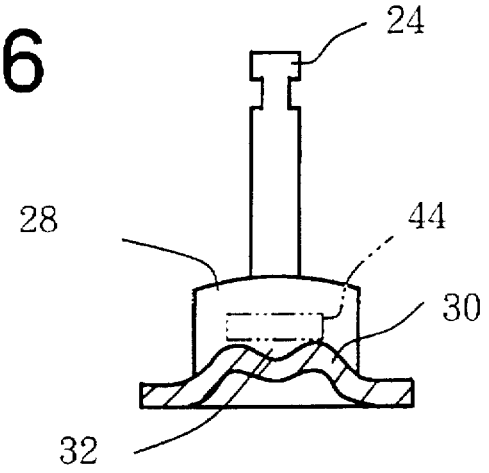
FIG. 6 is a cross-sectional view taken along the line 6—6 of FIG. 4.

The first terminal 10, as is apparent from FIG.4 showing the front shape, FIG.5 showing the side shape and FIG.6 showing a cross-sectional shape taken along the line 6—6 of FIG.4, is provided with a wide main body 22, with a winding connection section 24 formed at one end and an engaging projection 26 formed at the other end by bending the first terminal 10 so that these ends extend in parallel in the same direction.

The middle portion of main body 22 is provided with a cut and raised upright wall 28 integrally formed thereon. A bulged section 30 is formed between the upright wall 28 and the engaging projection 26. The top of the bulged section 30 is longitudinally provided with a recess 32 (see FIG.6).

A portion of the first terminal 10 from the upright wall 28 to the winding connection section 24 is adapted to engage a groove 34 formed on the side of the bobbin 2. In this case, the upright wall 28 contacts a step section 36 (see FIG.3) which serves as a positioning stopper.

The winding connection section 24 is narrower than the main body 22. The winding terminal 8 is securely soldered to the top end of the winding connection section 24. The winding connection section 24 is then bent within a slit 38 which is formed on the side of the bobbin 2, exposing the center portion in the longitudinal direction of the main body 22. The winding connection section 24 is positioned to overlap the main body 22.

The upright wall 28 projects to such an extent that when the winding connection section 24 is bent on the main body 22, the top end of the winding section 24 overlaps the upright wall 28 in the longitudinal direction of the main body 22. When fluid resin injected during the formation of the mold portion 20 flows in the bent top end direction of the winding connection section 24 along the main body 22, the top end of the winding connection section 24 is not raised by the flow pressure of the fluid resin.

Figure 7:
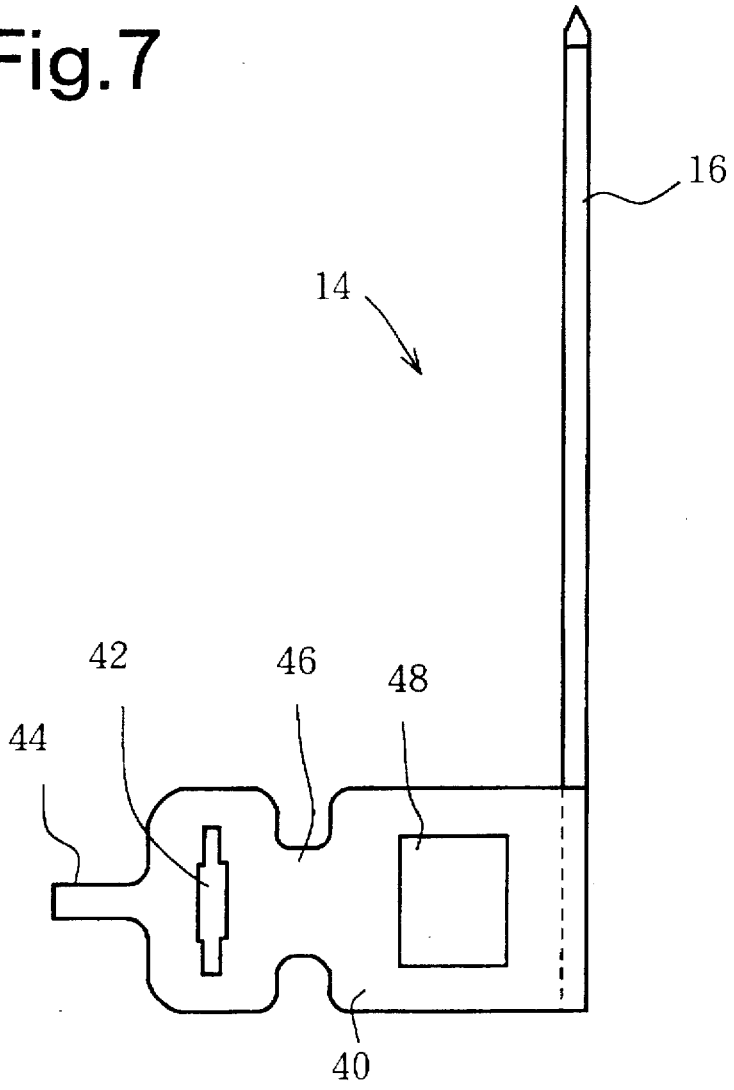
FIG. 7 is a front view of the second terminal.

As is apparent from FIG.7, the second terminal 14 comprises a main body 40 connected to the first terminal 10, and the coupler terminal 16. The second terminal 14 is formed in a general L-shape. The main body 40 is formed with a long engaging opening 42 which is adapted to engage with the engaging projection 26 in the lateral direction. The main body 40 is also provided with a top end 44 narrowed toward the top end side from the engaging opening 42.

The main body 40 is also provided laterally with a constricted part 46 deeply cut from both sides thereof near the engaging opening 42 and on the side opposite the top end portion 44. The width of the constricted area 46 is almost half the width of each of the engaging opening 42 and the top end portion 44. However, it should be noted that the width of the constricted area 46 may be narrowed or the constricted area 46 itself may be eliminated.

Figure 3:
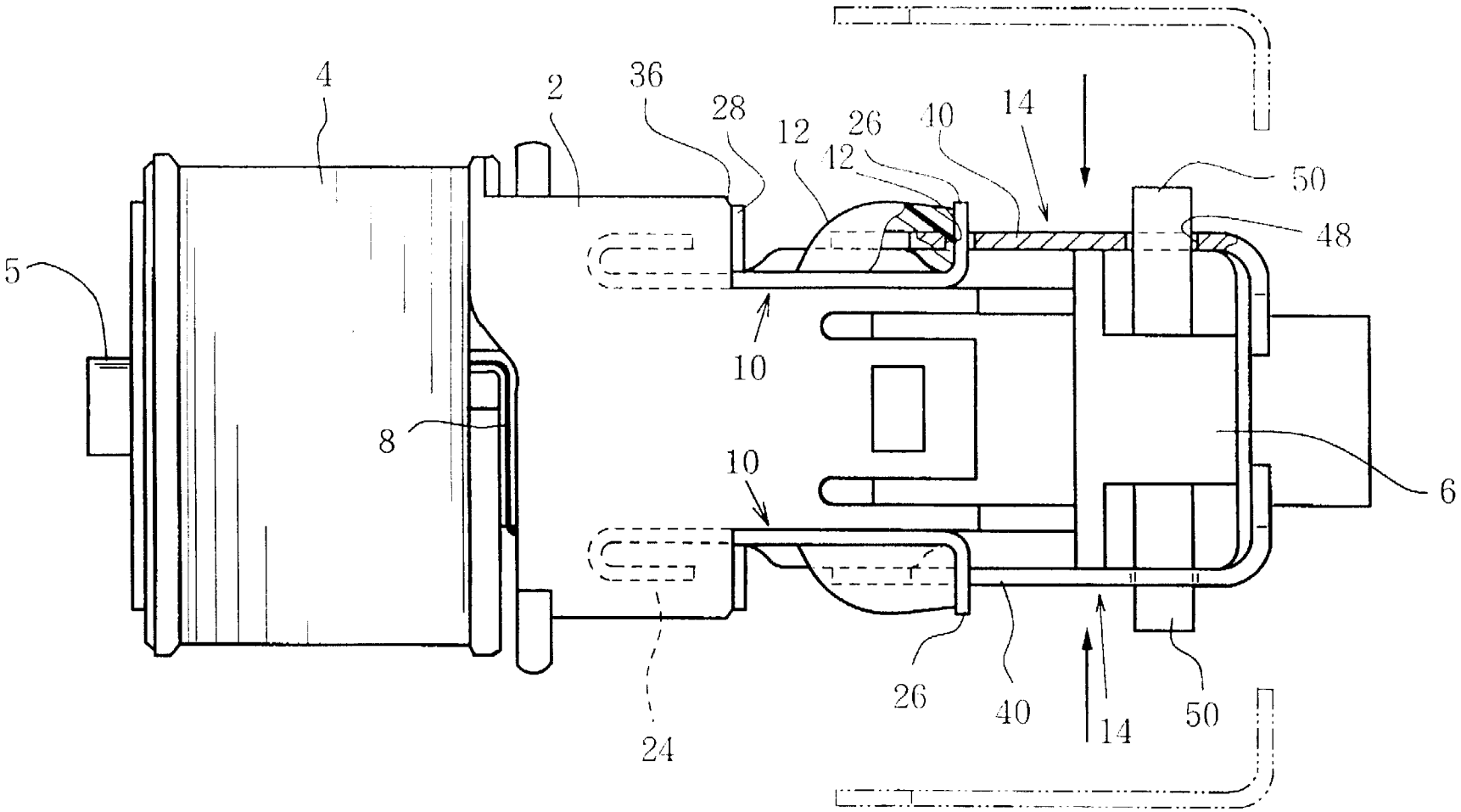
FIG. 3 is a view showing installation of the second terminal 14.

Formed on the side of the coupler terminal 16 from the constricted area 46 of the main body portion 40 is an installation opening 48 which is adapted to engage with an installation projection 50 formed to project to the side of a terminal base 6 (see FIG. 3).

Figure 1:
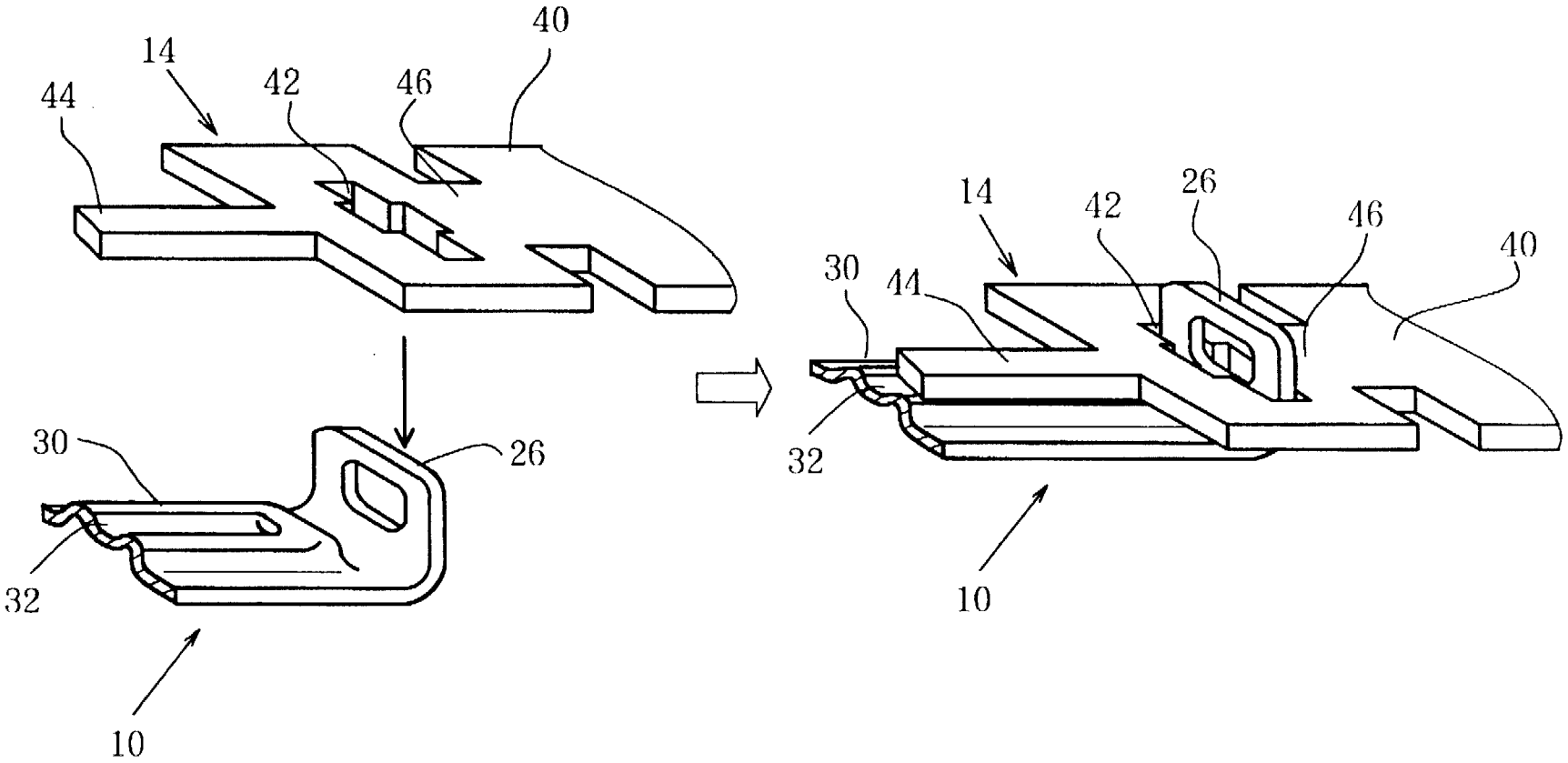
FIG. 1 is a view showing a structure for connecting a first terminal to a second terminal according to a preferred embodiment of the present invention.

FIGS. 1 and 3 show the method of connecting the first terminal 10 to the coil 4. Referring first to FIG. 3, the first terminal 10 is secured to the bobbin 2 and then, the second terminal 14 is pushed from the side to the side of the terminal base 6 to allow the installation projection 50 to engage the installation opening 48, thereby incorporating the second terminal 14 with the side of the terminal base 6 (see FIG. 1).

In this case, the engaging projection 26 is inserted into the engaging opening 42 to engage one end of the first terminal 10 with one end of the second terminal 14 and the top end 44 is positioned to overlap the bulged portion 30 of the first terminal 10. At the same time, the bulged portion 30 and the top end 44 are soldered to form a soldered section 12.

During this soldering, it is difficult to transfer the heat of soldering to the side of the coupler terminal 16 from the constricted part 46 of the main body 40 so that cooling slows and the heat escape from the soldering iron decreases. Thus, the efficiency of the soldering can be improved.

Further, because the first terminal 10 and the second terminal 14 are connected to each other by engaging the engaging projection 26 which is bent at a substantially right angle in the longitudinal direction, with the main body 40 and each connecting portion firmly secured, it is to be understood that the soldered portion is not affected by stress resulting from differences in the efficiency of thermal expansion of the terminals, the solder and the resin due to changes in the application temperature. Therefore, it is possible to improve the reliability of the soldered portion.

The present invention is not confined to the embodiment described above, but may be embodied or practiced in other various ways without departing from the spirit or essential character thereof. For instance, the engaging projection 26 may be formed on the side of the second terminal 14, while the engaging opening 42 may be formed on the side of the first terminal 10.

What is claimed is:

1. A terminal device of a coil comprising:

a first terminal, to one end of which a winding terminal of the coils connected;

a second terminal disposed in the same longitudinal direction as the first terminal and having its top end positioned to overlap the other end of the first terminal, thereby connecting the top end of the second terminal to the other end of the first terminal by soldering; and means projecting outwardly at approximately ninety degrees from at least one of said first terminal and said second terminal and being provided on one of the first terminal or the second terminal for positively limiting displacement in longitudinal direction of the first terminal and the second terminal for preventing stress from being applied to the soldered portion.

2. The terminal device of a coil according to claim 1, and further including an opening being provided in at least one of said first terminal and said second terminal for receiving said means projecting outwardly from at least one of said first terminal and said second terminal for positively limiting displacement therebetween.

3. The terminal device of a coil according to claim 1, and further including an upright wall displaced from said means projecting outwardly from at least one of said first terminal and bobbin portion of said coil.

4. The terminal device of a coil according to claim 1, and further including a winding connection section projecting from said first terminal for retaining a bobbin portion of said coil.

5. The terminal device of a coil according to claim 4, wherein said winding connection has a width which is narrower relative to a width of a main body of said first terminal.

6. A terminal device of a coil comprising:

a first terminal, to one end of which a winding terminal of the coil is connected;

a second terminal disposed in the same longitudinal direction as the first terminal and having its top end positioned to overlap the other end of the first terminal, thereby connecting the top end of the second terminal to the other end of the first terminal; and wherein an engaging projection is provided and projects one of the first terminal or the second terminal, while an engaging opening for engaging the engaging projection is provided on the other of the first terminal or the second terminal for positively limiting displacement therebetween.

7. The terminal device of a coil according to claim 6, wherein a constricted area is formed near the engaging opening.

8. The terminal device of a coil according to claim 6, wherein the engaging projection is formed by bending a portion of one of the first terminal or the second terminal.

9. The terminal device of a coil according to claim 6, and further including an upright wall displaced from said means projecting outwardly from at least one of said first terminal and bobbin portion of said coil.

10. The terminal device of a coil according to claim 6, and further including a winding connection section projecting from said first terminal for retaining a bobbin portion of said coil.

11. The terminal device of a coil according to claim 10, wherein said winding connection has a width which is narrower relative to a width of a main body of said first terminal.

* * * * *